US008519251B2

(12) United States Patent
Lingel

(10) Patent No.: US 8,519,251 B2
(45) Date of Patent: Aug. 27, 2013

(54) MAGNETIC INSTRUMENT PICKUP

(75) Inventor: Thomas Lingel, Fayetteville, NY (US)

(73) Assignee: Anaren, Inc., East Syracuse, NY (US)

( * ) Notice: Subject to any disclaimer, the term of this patent is extended or adjusted under 35 U.S.C. 154(b) by 178 days.

(21) Appl. No.: 12/915,987

(22) Filed: Oct. 29, 2010

(65) Prior Publication Data

US 2012/0103169 A1 May 3, 2012

(51) Int. Cl.
*G10H 3/00* (2006.01)

(52) U.S. Cl.
USPC ..... 84/723; 84/725; 84/726

(58) Field of Classification Search
None
See application file for complete search history.

(56) References Cited

U.S. PATENT DOCUMENTS

| | | | | |
|---|---|---|---|---|
| 4,568,555 | A | 2/1986 | Spanier | |
| 4,580,478 | A * | 4/1986 | Brosh et al. | 84/688 |
| 4,584,199 | A | 4/1986 | Taylor | |
| 5,204,487 | A * | 4/1993 | Turner | 84/731 |
| 5,670,197 | A | 9/1997 | Adrianson et al. | |
| 7,166,793 | B2 * | 1/2007 | Beller | 84/723 |
| 7,601,908 | B2 | 10/2009 | Ambrosino | |
| 7,989,690 | B1 * | 8/2011 | Lawing | 84/726 |
| 8,269,095 | B1 * | 9/2012 | Wallace | 84/726 |
| 2003/0169039 | A1 | 9/2003 | Kang et al. | |
| 2004/0044382 | A1 | 3/2004 | Ibrahim | |
| 2005/0024750 | A1 | 2/2005 | Kato | |
| 2005/0060732 | A1 | 3/2005 | Kang et al. | |
| 2006/0062885 | A1 | 3/2006 | Jacobson et al. | |
| 2006/0077785 | A1 | 4/2006 | Kuo | |
| 2009/0085706 | A1 | 4/2009 | Baarman et al. | |
| 2010/0231340 | A1 * | 9/2010 | Fiorello et al. | 336/92 |
| 2012/0055320 | A1 * | 3/2012 | Morong | 84/746 |
| 2012/0103169 | A1 * | 5/2012 | Lingel | 84/726 |
| 2012/0112691 | A1 * | 5/2012 | Kurs et al. | 320/108 |
| 2012/0119698 | A1 * | 5/2012 | Karalis et al. | 320/108 |
| 2012/0272815 | A1 * | 11/2012 | Lingel et al. | 84/726 |

OTHER PUBLICATIONS

Tanaka, et al., 1979, *A Challenge of Pasteurized Prosess Cheese Spread with Clostridium botullium Spores*, Journal of Food Protection; 42 (10) 787-789.

Tanaka, N., 1982, *Challenge of Pasteurized Process Cheese Spreads with Clostridium botulinum Using In-Process and Post-Process Inoculation*, Journal of Food Protection; 45 (11) 1044-1050.

Tanaka, et al., 1986, *Evaluation of Factors Involved in Antibotulinal Properties of Pasteurized Process Cheese Spreads*, Journal of Food Protection; 49 (17) 526-531.

Somers, et al., 1987, *Antibotulinal Effectiveness of Nisin in Pasteurized Process Cheese Spread*, Journal of Food Protection; 50 (10) 842-848.

Kalra, et al., 1992, *Nisin as an Aid in Extending Shelf-Life of Various Foods*, Indian Food Packer; 46 (2) 5-15.

(Continued)

*Primary Examiner* — Marlon Fletcher

(74) *Attorney, Agent, or Firm* — Daniel P. Malley; Bond Schoeneck & King, PLLC

(57) ABSTRACT

An instrument pickup including a stack of thin laminated printed circuit boards. Each layer includes an etched coil conductor structure with narrow lines and spaces defining the coil structure. The layers are connected via through holes. The etched lines are smaller than the insulated copper wire (also sometimes called magnetic wire) of a conventional instrument pickup, which means that the size, volume and/or height of the pickup may be reduced relative to a conventional wire wound instrument pickup.

15 Claims, 4 Drawing Sheets

(56) References Cited

OTHER PUBLICATIONS

Roberts, et al., 1993, *Shelf-Life of Pasteurized Process Cheese Spreads Made From Cheddar Cheese Manufactured with a Nissin0-Producing Starter Culture*, Journal of Dairy Science; 76 (7) 1829-1836.
Zottola, et al., 1994, *Utilization of Cheddar Cheese Containing Nisin as an Antimicrobial Agent in Other Foods*, Int'l Journal of Food Microbiology; 24 (1/2) 227-238.
Eckner, et al., 1994, *Contribution of Composition, Physiochemical Characteristics and Polyphosphates to the MicroBial Safety of Pasteurized Cheese Spreads*, Journal of Food Protection, 57 (4) 295-300.
Delves-Broughton, J., 1997, *The Food Preservative Nisin*, Food Techonogist; 27 (3) 100-103.
Tomas, et al., 2000, *Nisin*, 462-524.
Fox, et al., 2000, *Processed Cheese and Substitute or imitation Cheese*, 429-451.
Abee, et al., 2003, *Bacteriocins—Nisin*, 146-178.
Glass, et al., 2004, *Factors the Contribute to the Botulinal Safety of Reduced-Fat and Fat-Free Process Cheese Products*, Journal of Food Protection; 67 (8) 1687-1693.
Delves-Broughton, J., 2005, *Nisin as a Food Preservative*, Food Australia; 57 (12) 525-527.
http://www2.electronicproducts.com/A_component_that_marks_the_end_of_hand_wound_coils_in_datacom-article-poyrc07_jan2012-html.aspx, as of Jan. 1, 2012, pp. 1-2.
Tyco Electronics Corporation, White Paper, Improving Data Communication Products with Planar Magnetics, 2011, http://www.te.com/planarmag, pp. 1-6.

* cited by examiner

MAGNETIC INSTRUMENT PICKUP

BACKGROUND OF THE INVENTION

1. Field of the Invention

The present invention relates to magnetic-to-electrical transducers, and more particularly to magnetic-to-electrical transducers suitable for use as magnetic pickups for musical instruments having vibrating strings.

2. Description of the Related Art

Magnetic pickups for musical instruments (for example, electric guitars, electric basses) are conventional. A conventional magnetic pickup includes a permanent magnet (such as an AlNiCo magnet) wrapped with a coil of a few thousand turns of fine enameled copper wire. The instrument pickup can be mounted on the body of the instrument, the bridge, the neck and/or the pickguard. The vibration of the nearby soft-magnetic strings modulates the magnetic flux linking the coil, thereby inducing an alternating current through the coil of wire around the magnet. This electrical signal is then carried to other components, such as an amplifier, a speaker, recording equipment or the like. The operation of the pickup can be described using the concept of a magnetic circuit, in which the motion of the string varies the magnetic reluctance in the circuit created by the permanent magnet.

A printed circuit boards ("PCBs") is conventional. A PCB is used to mechanically support and electrically connect electronic components using conductive pathways. Tracks, or signal traces, etched from conductive sheets (for example, copper sheets) are laminated onto a non-conductive substrate. PCBs are also sometimes referred to as printed wiring board ("PWB") or etched wiring board. A PCB formed with electronic components is sometimes referred to as a printed circuit assembly ("PCA"), a printed circuit board assembly ("PCBA"), or even sometimes simply as a printed circuit board ("PCB").

Printed circuit board style conductor coils ("PCB coils") are conventional. PCB coils are conductive coils formed as tracks, or signal traces, on a printed circuit board. For example, US patent application 2004/0044382 ("Ibrahim") discloses an auditory prosthesis that uses a PCB coil as a transmission coil.

U.S. Pat. No. 7,601,908 ("Ambrosino") discloses a musical instrument including an active pickup transducer, a passive pickup transducer and a switch for allowing a user to select between the active pickup transducer and the passive pickup transducer. The transducers are disclosed to be conventional wire coil type transducers or piezoelectric transducers. As is widely conventional, the active transducer includes signal amplification of the transduced electrical signal, while the passive transducer does not. the switch is disclosed to be mounted on a printed circuit board ("PCB").

The following published documents may also include helpful background information: (i) US patent application 2009/0085706 ("Baarman").

Description Of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

The present invention is directed to a magnetic instrument pickup that uses a PCB coil. Preferably, the PCB coil is in the form of a stack of PCB layers, with each layer including substrate and PCB-style windings (see DEFINITIONS section).

Various embodiments of the present invention may exhibit one or more of the following objects, features and/or advantages:

(i) smaller musical instrument magnetic pickup;

(ii) narrower profile musical instrument pickup;

(iii) flexibility in regards to modifying lumped element parameters like inductance, capacitance and/or resonance frequency by use of a PCB coil (see DEFINITIONS section); and (iv) PCB platform allows integration of an amplifier to make an active pickup transducer according to the present invention.

According to a first aspect of the present invention, a magnetic pickup is used with a musical instrument having a vibrating string. The pickup includes: a PCB coil; a magnet; a connection hardware set; and a line out. The magnet is located in proximity to the PCB coil. The connection hardware set mechanically connects the magnet to the PCB coil. The magnet, the PCB coil and the connection hardware set are sized, shaped and/or connected so that when the magnet is placed in proximity to the vibrating string, an electrical signal will be induced in the PCB coil. The line out comprises at least one conductive path suitable for conducting the induced electrical signal to an instrument-signal-receiving component.

According to a further aspect of the present invention, a musical instrument includes: an instrument body; a first vibrating string; and a first pickup. The first pickup includes: a PCB coil, a magnet, a connection hardware set, and a line out. The first vibrating string is mechanically connected to the instrument body so that a vibrating portion of the first vibrating string is free to vibrate. The magnet of the first pickup is located in proximity to the PCB coil of the first pickup and in proximity to the first vibrating string. The connection hardware of the first pickup mechanically connects the magnet of the first pickup to the PCB coil of the first pickup. The magnet of the first pickup, the PCB coil of the first pickup and the connection hardware set of the first pickup are sized, shaped and/or connected so that vibration of the first vibrating string will induce an electrical signal will be induced in the PCB coil of the first pickup. The line out of the first pickup comprises at least one conductive path suitable for conducting the induced electrical signal in the PCB coil of the first pickup to an instrument-signal-receiving component.

According to a further aspect of the present invention, a musical instrument includes: an instrument body; a first vibrating string; and a first pickup. the first pickup includes: a PCB coil, a connection hardware set, and a line out. The first vibrating string is structured and/or connected to be magnetic. The first vibrating string is mechanically connected to the instrument body so that a vibrating portion of the first vibrating string is free to vibrate. The connection hardware of the first pickup mechanically connects the PCB coil in proximity to at least a portion of the vibrating string. The first vibrating string, the PCB coil of the first pickup and the connection hardware set of the first pickup are sized, shaped and/or connected so that vibration of the first vibrating string will induce an electrical signal will be induced in the PCB coil of the first pickup. The line out of the first pickup comprises at least one conductive path suitable for conducting the induced electrical signal in the PCB coil of the first pickup to an instrument-signal-receiving component.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
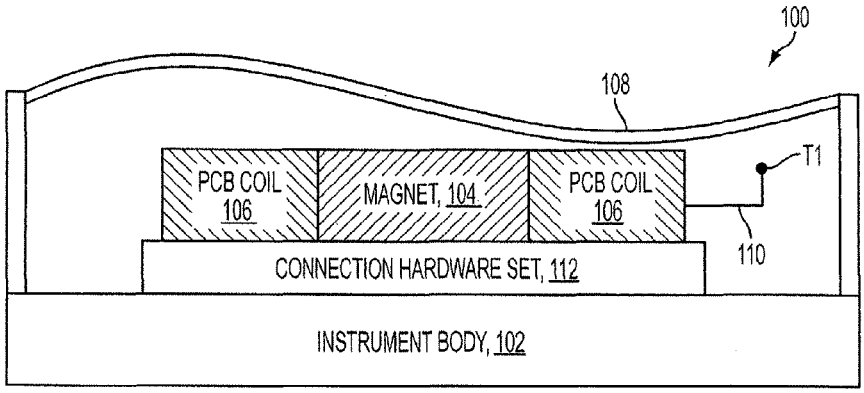
FIG. 1 is a side view of a first embodiment of a musical instrument according to the present invention.
Figure 2:
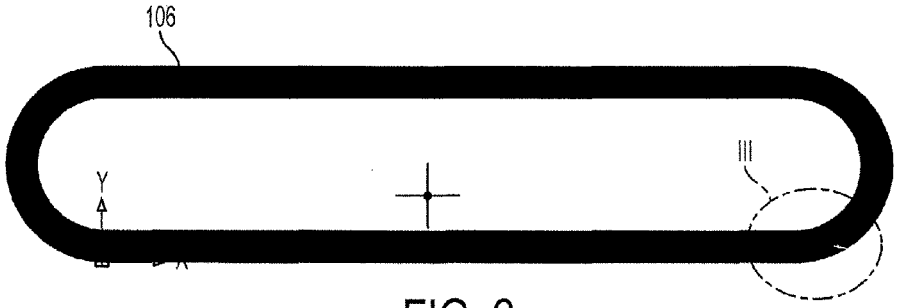
FIG. 2 is a view of a PCB coil for use in the present invention.
Figure 3:
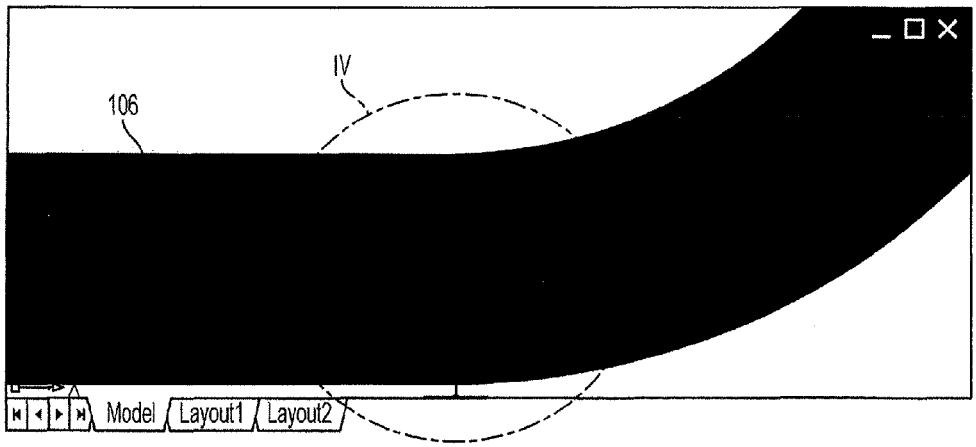
FIG. 3 is a magnified view of a portion of the FIG. 2 coil.
Figure 4:
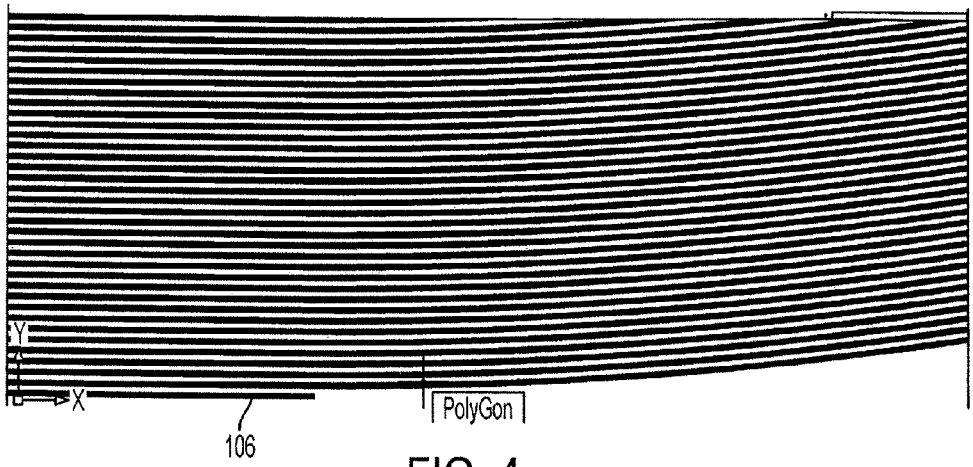
FIG. 4 is a magnified view of a portion of the FIG. 3 portion of the FIG. 2 coil.

FIG. 1 shows musical instrument 100, including: instrument body 102; permanent magnet 104; PCB coil 106; vibrating string 108; line out 110; electrical terminal T1; and connection hardware set 112. For clarity of illustration purposes, FIG. 1 is not drawn to scale (or even close to scale). The magnet and PCB coil are shown in cross-section. PCB coil 106 surrounds magnet 104. FIGS. 2, 3 and 4 show the PCB coil. These Figures are drawn at least approximately to scale. While the magnet in this preferred embodiment is a permanent magnet, it could alternatively be an electromagnet (of any type now known or to be developed in the future). As will be discussed below, in some embodiments of the present invention, the vibrating string may be magnet, and may obviate the need for a separate magnet. The vibrating string must be made of such a material that the vibration of the vibrating string will cause changes in the magnetic field that can be transduced into an electrical signal (or changes in a an electrical signal) by the PCB coil.

PCB coil 106 and magnet 104 are designed so that the vibrating string will induce the level of AC signal typical of a musical instrument. Line out 110 and electrical terminal are lines and terminals of a type suitable for carrying, and electrically connecting to other components (not shown), the AC signal induced by the vibrating string in the magnetic pickup. Connection hardware set 112 mechanically connects (see DEFINITIONS section) the magnet to the PCB coil within which it resides. It is noted that the connection hardware may take many, many forms, such as (and without limitation) glue, screws, rivets, hook-and-latch fastener material, interference fits (for example, interference fits with recesses in the instrument body itself, adhesive tape, and so on. To any extent that the magnet must move with respect to the coil, the connection hardware set should be designed to provide for that. While instrument 100 has just one string and one pickup, preferred musical instruments according to the present invention will generally have multiple strings and a corresponding number of respectively allocated pickups. In some embodiments of the present invention, magnetic pickups according to the present invention and conventional wire wound pickups may be employed in combination, according to space requirements and performance objectives.

There are many possible variations with regard to the correlation between pickups and strings. For example, some embodiments of the present invention will have but a single PCB coil transducer for transducing the vibration and associated flux changes associated with all six vibrating strings of an electric guitar. In preferred electric guitar embodiments, there will be one or two or three pickups, with each pickup transducing the vibration of all six strings of the guitar as a single composite electrical signal. Other embodiments may have one (or more) transducer(s) per some subset of strings of the instrument. Other embodiments may have multiple transducers for a common set of strings, and these transducers may or may not be user selectable in the alternative. Other embodiments may exhibit a one-to-one correspondence between transducers and strings. Other embodiments may have multiple, dedicated transducers for each and every string. Generally speaking, the compact design of transducers according to the present invention may facilitate the design of musical instruments with a greater number of pickups than were present in analogous instruments having wire would coil pickups.

Although PCB coil 106 has only a single PCB layer, preferred PCB coils according to the present invention include a stack of PCB coil layers. Preferably, the geometry of such a preferred multi-layer PCB coil is such that the narrow conductive lines and spaces of each layer are connected with via's and/or through holes.

In instrument 100, advanced PCB technology is used to fabricate a solenoid structure with a similar number of windings to the number of windings in a conventional wire wound pickup device. Conventional pickup devices, which are used for instance in electric guitars, have approximately 5000 to 12000 windings and usually a 42 AWG (2.8 mil thick) insulated copper wire. In conventional pickups the insulated copper wire windings are used to wind a solenoid onto a bobbin. Permanent magnets are arranged inside the bobbin to magnetize the strings of the instrument. The vibration of the string will induce a current of the vibration's frequency in the coil. The present invention replaces the conventional coil with a PCB coil.

Preferred PCB coils for use in the present invention are preferably made of a stack of PCB layers, with each layer preferably being ~1 to 5 mil thick. Preferably, the stack of layers is laminated together. Each layer preferably includes an etched spiral structure with narrow lines and spaces (~2 mil thick). These layers are preferably connected via through holes. In preferred embodiments, starting from the outside, a copper trace winds in and is then connected to the next layer, where the trace winds outward in the same winding orientation. If, for example, 200 windings are realized on one layer, and the stack includes 40 PCB layers, then the PCB coil will have a total of 8000 windings. These 8000 windings can be realized in a package with an overall height of only ~40 mil to ~500 mil. The spacing and width of the wire traces, as well as the dielectric properties of the PCB material can be tailored to achieve a required capacitance. The number of windings mainly impacts the total inductance of the pickup device. In this way, the present invention may allow for more design flexibility than a conventional wire wound pickup device. Furthermore, amplifier(s) can be directly integrated onto the PCB structure used to support the traces making up the windings of the PCB coil so that the pickup is an active pickup, instead of a passive pickup.

Figure 5:
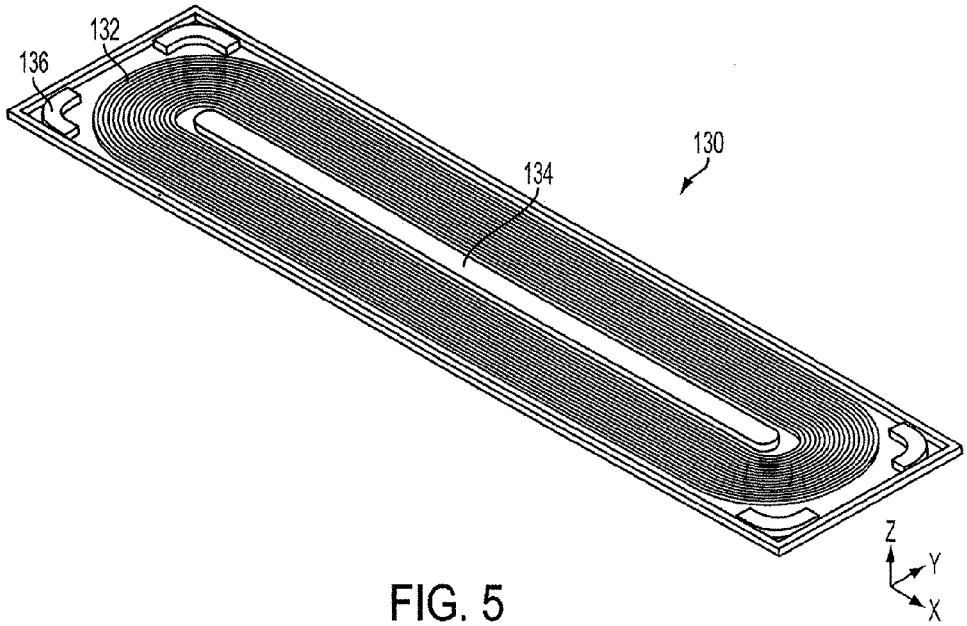
FIG. 5 is a perspective view of certain components of the musical instrument of FIG. 1.

FIG. 5 shows a perspective view (generally a top view) of intermediate stage PCB coil portion 130. Portion 130 is an embodiment of a portion of a PCB coil for use in the present invention as it is being manufactured, but before the PCB coil is complete. Portion 130 includes: partial PCB coil stack 132; central copper guide segment 134; and corner copper guide segments 136. The copper guide segments help the PCB from warping due to thermal changes as it is being manufactured, as will be readily appreciated by those of skill in the art. In this embodiment, each portion 130 includes 13 or 14 layers, and three layers are stacked and electrically connected to each other (for example, in series, in parallel), in order to form final PCB coil 106. The possible relative positioning of coil 106 and magnet 104 will now be discussed with reference to FIG. 5. In the final instrument assembly, the magnet is preferable located where central copper guide is shown in FIG. 5, which is to say inside of an interior space defined by the coil. However, other relative positionings are possible, so long as the magnet and coil are mutually in vicinity. For example, the magnet could be placed over, under or to the peripheral side of the coil. As a further example, the magnet could be made in multiple segments and places at various locations around the coil. As a more specific variation on the foregoing example, segments of the magnet could be placed where corner copper guide segments are shown in FIG. 5. Also a common magnet may be located in proximity to more than one coil.

Figure 6:
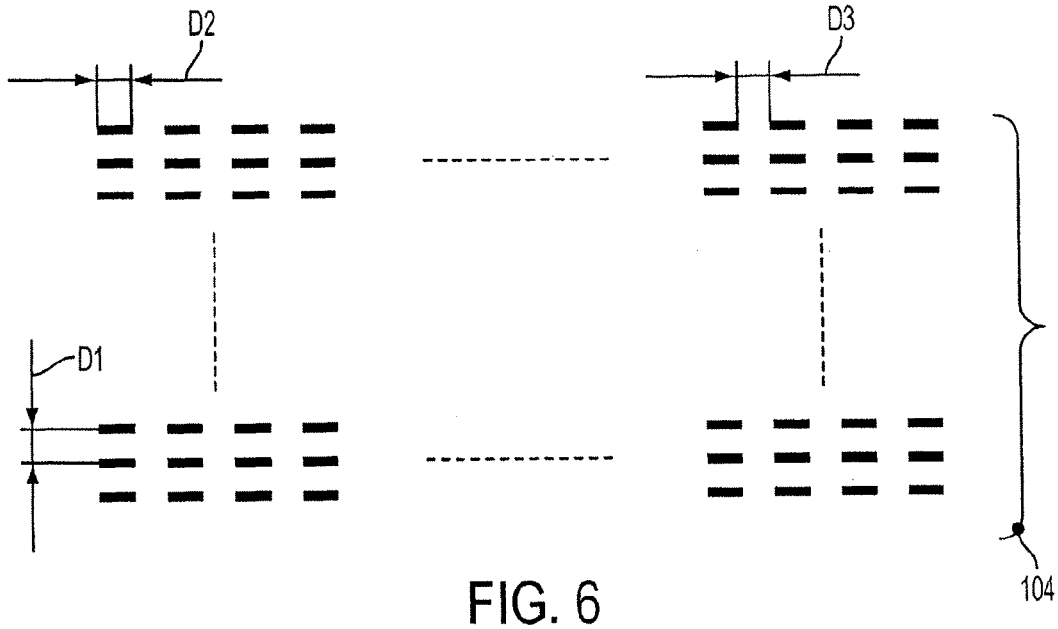
FIG. 6 is a schematic cross-sectional view of a PCB coil for use in the present invention.

FIG. 6 shows a schematic cross section of coil 104, with a few of the conductive traces shown as black dashes. Some exemplary dimensions are as follows: (i) D1=0.040 inches; (ii) D2=0.001 inches; and (iii) D3=0.001 inches. Although only six layers are shown in FIG. 6, a typical stack would preferably have about 40 layers. Although the coil is shown as having four lines across, a typical coil would preferably have about 200 lines across. 200 windings per layer multiplied by 40 layers would yield 8000 windings in total.

Figure 7:
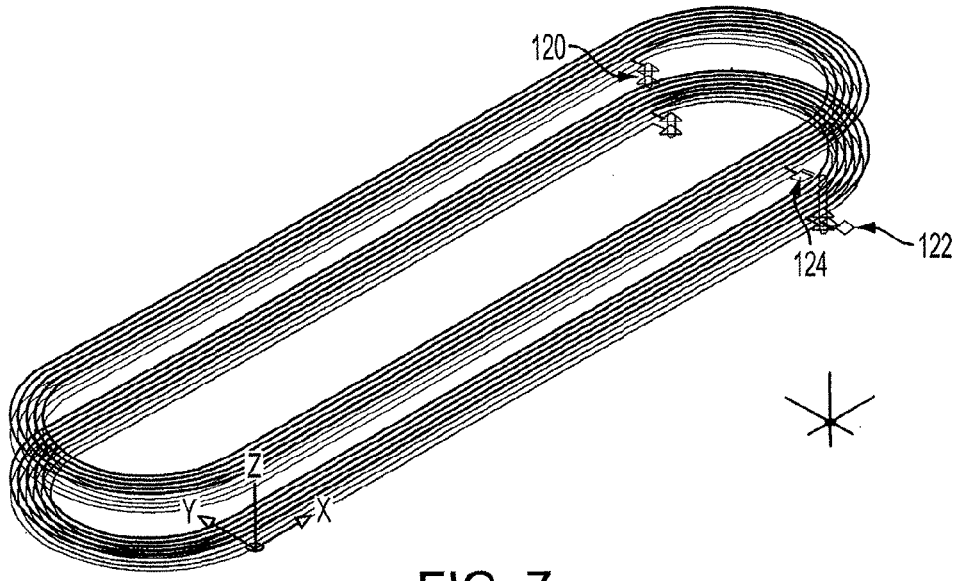
FIG. 7 is a perspective view of a portion of a PCB coil for use in the present invention.
Figure 8:
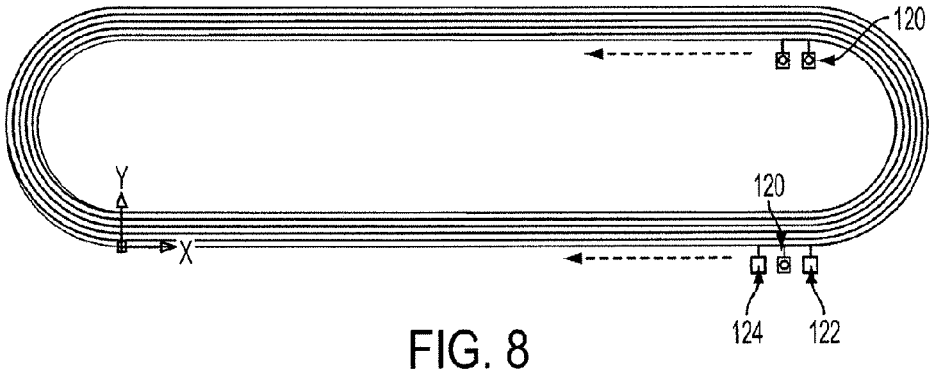
FIG. 8 is an orthographic top view of a portion of a PCB coil for use in the present invention.

FIGS. 7 and 8 show a portion of a PCB coil for use in the present invention, including interconnects 120; input port 122 and output port 124. The input ports, output ports and interconnects may be any type (now known or to be developed in the future) that is suitable for PCB applications. Rows of via connections will be wider according to the number of layers in the coil stack. Vias can be large (for example, 0.040 inches by 0.040 inches), either blind style or going through the entire height of the stack. The solenoid preferably winds in a clockwise (or counterclockwise) manner, in on one layer and back out on the next layer in an alternating fashion over the height of the stack.

Figure 9:
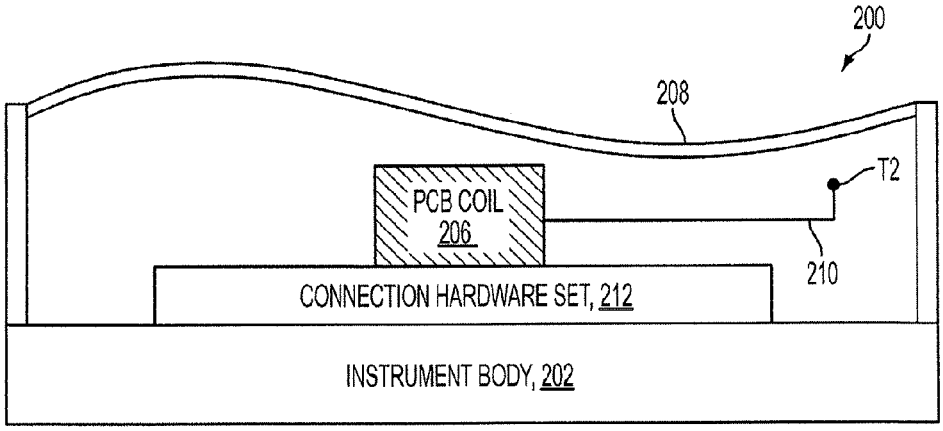
FIG. 9 is a side view of a second embodiment of a musical instrument according to the present invention.

FIG. 9 shows musical instrument 200 including: instrument body 202; PCB coil 206; vibrating magnetic string 208; line in/out 210; connection hardware set 212; and electrical connection terminal(s) T2. In the embodiment of FIG. 9, string 208 itself is made to be a magnet (that is, a permanent magnet or an electromagnet). The use of magnetic string may reduce or eliminate the need for a separate magnet (like magnet 104 in instrument 100). For example, instrument 200 includes no magnet apart from its magnetic string. the vibrations of this string cause changes in the magnetic field which are transduced into an electrical signal (or changes in an electrical signal) by PCB coil 206.

DEFINITIONS

Any and all published documents mentioned herein shall be considered to be incorporated by reference, in their respective entireties, to the fullest extent of the patent law. The following definitions are provided for claim construction purposes:

Present invention: means at least some embodiments of the present invention; references to various feature(s) of the "present invention" throughout this document do not mean that all claimed embodiments or methods include the referenced feature(s).

Embodiment: a machine, manufacture, system, method, process and/or composition that may (not must) meet the embodiment of a present, past or future patent claim based on this patent document; for example, an "embodiment" might not be covered by any claims filed with this patent document, but described as an "embodiment" to show the scope of the invention and indicate that it might (or might not) covered in a later arising claim (for example, an amended claim, a continuation application claim, a divisional application claim, a reissue application claim, a re-examination proceeding claim, an interference count); also, an embodiment that is indeed covered by claims filed with this patent document might cease to be covered by claim amendments made during prosecution.

First, second, third, etc. ("ordinals"): Unless otherwise noted, ordinals only serve to distinguish or identify (e.g., various members of a group); the mere use of ordinals shall not be taken to necessarily imply order (for example, time order, space order).

Electrically Connected: means either directly electrically connected, or indirectly electrically connected, such that intervening elements are present; in an indirect electrical connection, the intervening elements may include inductors and/or transformers.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, quick-release connections, latches and/or magnetic connections), force fit connections, friction fit connections, connections secured by engagement caused by gravitational forces, pivoting or rotatable connections, and/or slidable mechanical connections.

Receive/provide/send/input/output: unless otherwise explicitly specified, these words should not be taken to imply: (i) any particular degree of directness with respect to the relationship between their objects and subjects; and/or (ii) absence of intermediate components, actions and/or things interposed between their objects and subjects.

PCB-style windings: any sort of conductive path (now known or to be developed in the future) that in suitable for forming in and/or on a PCB substrate by PCB forming techniques; PCB-style windings include, but are not necessarily limited to, traces, tracks, etched conductive pathways, via's, etc.

PCB coil: a conductive coil that is made of PCB substrate material and PCB-style windings, regardless of coil geometry, number of layers, etc.; a PCB coil may have other electronic components on and/or in it, in addition to the PCB style windings; a PCB coil may be a single layer, but is preferably a multiple layer stack.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control.

Unless otherwise explicitly provided in the claim language, steps in method steps or process claims need only be performed in the same time order as the order the steps are recited in the claim only to the extent that impossibility or extreme feasibility problems dictate that the recited step order be used. This broad interpretation with respect to step order is to be used regardless of whether the alternative time ordering(s) of the claimed steps is particularly mentioned or discussed in this document—in other words, any step order discussed in the above specification shall be considered as required by a method claim only if the step order is explicitly set forth in the words of the method claim itself. Also, if some time ordering is explicitly set forth in a method claim, the time ordering claim language shall not be taken as an implicit limitation on whether claimed steps are immediately consecutive in time, or as an implicit limitation against intervening steps.

What is claimed is:

1. A magnetic pickup for use with a musical instrument having a vibrating string, the pickup comprising:
a PCB coil;
a magnet;
a connection hardware set; and
a line out;
wherein:
the magnet is located in proximity to the PCB coil;
the connection hardware set mechanically connects the magnet to the PCB coil;
the magnet, the PCB coil and the connection hardware set are sized, shaped or connected so that when the magnet is placed in proximity to the vibrating string, an electrical signal will be induced in the PCB coil; and
the line out comprises at least one conductive path suitable for conducting the induced electrical signal to an instrument-signal-receiving component.

2. The pickup of claim 1 wherein:
the PCB coil comprises a plurality of PCB-style windings; and
the plurality of PCB-style windings are arranged as at least one layer of concentric, generally-rectangular-shaped profile windings, with the general rectangular shape being characterized by a pair of relatively long sides and a pair of relatively short sides.

3. The pickup of claim 2 wherein the pair of relatively short sides are each rounded.

4. The pickup of claim 1 wherein the PCB coil further comprises at least one amplifier.

5. The pickup of claim 1 wherein:
the PCB coil defines an interior space; and
the magnet is located at least substantially within the interior space of the PCB coil.

6. The pickup of claim 1 wherein the PCB coil comprises a plurality of PCB coil layers arranged in a stack, with each layer comprising a PCB substrate and a plurality of PCB-style windings.

7. The pickup of claim 6 wherein the windings of adjacent layers are connected via conductive through holes in the PCB substrate.

8. The pickup of claim 6 wherein the stack of layers is laminated.

9. The pickup of claim 1 wherein the magnet comprises at least one permanent magnet segment.

10. A musical instrument comprising:
an instrument body;
a first vibrating string; and
a first pickup comprising:
a PCB coil,
a magnet,
a connection hardware set, and
a line out;
wherein:
the first vibrating string is mechanically connected to the instrument body so that a vibrating portion of the first vibrating string is free to vibrate;
the magnet of the first pickup is located in proximity to the PCB coil of the first pickup and in proximity to the first vibrating string;
the connection hardware of the first pickup mechanically connects the magnet of the first pickup to the PCB coil of the first pickup;
the magnet of the first pickup, the PCB coil of the first pickup and the connection hardware set of the first pickup are sized, shaped or connected so that vibration of the first vibrating string will induce an electrical signal will be induced in the PCB coil of the first pickup; and
the line out of the first pickup comprises at least one conductive path suitable for conducting the induced electrical signal in the PCB coil of the first pickup to an instrument-signal-receiving component.

11. The instrument of claim 10 wherein:
the first vibrating string is one of a plurality of vibrating strings; and
the first pickup is one of a plurality of pickups constructed similarly to the first pickup.

12. The instrument of claim 11 wherein the instrument body and the plurality of vibrating strings are sized, shaped or connected so that the instrument is an electric guitar.

13. The instrument of claim 11 wherein the instrument body and the plurality of vibrating strings are sized, shaped or connected so that the instrument is an electric bass.

14. The pickup of claim 10 wherein:
the PCB coil of the first pickup defines an interior space; and
the magnet of the first pickup is located at least substantially within the interior space of the PCB coil.

15. A musical instrument comprising:
an instrument body;
a first vibrating string; and
a first pickup comprising:
a PCB coil,
a connection hardware set, and
a line out;
wherein:
the first vibrating string is structured or connected to be magnetic;
the first vibrating string is mechanically connected to the instrument body so that a vibrating portion of the first vibrating string is free to vibrate;
the connection hardware of the first pickup mechanically connects the PCB coil in proximity to at least a portion of the vibrating string;
the first vibrating string, the PCB coil of the first pickup and the connection hardware set of the first pickup are sized, shaped or connected so that vibration of the first vibrating string will induce an electrical signal will be induced in the PCB coil of the first pickup; and
the line out of the first pickup comprises at least one conductive path suitable for conducting the induced electrical signal in the PCB coil of the first pickup to an instrument-signal-receiving component.

* * * * *